United States Patent [19]

Swanson

[11] Patent Number: 4,651,348

[45] Date of Patent: Mar. 24, 1987

[54] GARMENT WITH SIDE-ACCESSIBLE POCKET STRUCTURES

[76] Inventor: Richard A. Swanson, 3902 NE. 157th Pl., Seattle, Wash. 98155

[21] Appl. No.: 815,530

[22] Filed: Jan. 2, 1986

Related U.S. Application Data

[63] Continuation-in-part of Ser. No. 708,493, Mar. 5, 1985.

[51] Int. Cl.[4] ..... A41D 1/02

[52] U.S. Cl. ..... 2/93; 2/94; 2/253

[58] Field of Search ..... 2/253, 93, 94

[56] References Cited

U.S. PATENT DOCUMENTS

| | | | |
|---|---|---|---|
| 993,383 | 5/1911 | Koretsky | 2/253 |
| 1,444,750 | 2/1923 | Moore | 2/94 |
| 1,507,396 | 9/1924 | Migdalowitz | 2/253 |
| 1,926,866 | 9/1933 | Doniger | 2/253 |
| 2,180,914 | 11/1939 | Speh | 2/253 |
| 2,224,752 | 12/1940 | Tworoger | 2/253 |
| 3,077,604 | 2/1963 | Colangelo | 2/93 |
| 3,217,335 | 11/1965 | Bell | 2/93 |

FOREIGN PATENT DOCUMENTS

| | | | |
|---|---|---|---|
| 2402381 | 4/1979 | France | 2/94 |
| 1239403 | 7/1971 | United Kingdom | 2/94 |

*Primary Examiner*—Louis K. Rimrodt
*Attorney, Agent, or Firm*—Garrison & Stratton

[57] ABSTRACT

A jacket structure comprising a front, a back, interconnecting side panels, a collar and sleeves, the front of the coat or jacket having two layers of material sewn together at appropriate locations to create upper and lower contiguous side-opening pockets on each panel of the front of the jacket. A common access to the upper and lower jacket pockets is closed along a seam by one closure means at each side of the front panel, which closure means serves one or both pockets.

8 Claims, 3 Drawing Figures

GARMENT WITH SIDE-ACCESSIBLE POCKET STRUCTURES

BACKGROUND OF THE INVENTION

1. RELATED APPLICATION

This application is a continuation-in-part of my Design Patent Application Ser. No. 708,493, filed Mar. 5, 1985.

BACKGROUND OF THE INVENTION

2. Technical Field

This invention relates to articles of clothing, particularly outer clothing such as jackets, vests, coats, shirts, pullovers, and the like.

3. Background Art

Various types of pocket structures are known for outer garments, including hidden pockets, pockets sewn in with various types of closures, slash pockets, flat pockets and the like. The pocket closures usually extend across a portion of the front of the garment and provide access to the hands of the wearer. Each pocket is usually provided with its own closure means.

Conventionally, many pockets are formed in garments such as jackets and vests with an access opening positioned in a centrally located area of the jacket front (i.e., top-flat type pocket). A previously formed pocket is sewn into the garment, which is then accessed through the opening cut through the garment structure itself or closed with an additional flap. Conventional side entry pockets often require a separate pocket bag and/or a special zipper setting machining. In many garment structures the additional pocket structure and its individual closures are time consuming to manufacturer and poses some difficulties in installation in the garment itself. The front material of the garment frequently must be cut, thus weakening the front panel of the garment.

4. Summary and Disclosure of the Invention

The basic feature of this invention resides in the provision of two pockets at each side of a garment which extend across approximately one half of the front of the garment and are accessible at or near the sides of the garment at a common entry seam. Having the two pockets positioned one above the other on one front panel of a garment such as a jacket, with the access at a side seam of the garment, permits the pockets to be formed by simply sewing through the two or more layers of the garment at appropriate locations and providing a closure means extending from approximately the anterior armpit of the garment to the waist of the garment. A single closure such as a zipper, hook-and-loop type, snap or button closure may suffice to close both pockets. Horizontal stitching may be used to form the pockets, but the pockets are preferably formed by stitching through the two layers of fabric on a line angling downwardly from the sides of the garment toward the center closure to facilitate retention of small articles in the upper storage pocket. The resulting jacket structure provides two large pockets in each front panel portion with the two pockets positioned vertically adjacent to each other. A common entry along a common seam permits access to one or both pockets from the side seam by the wearer. The jacket front panel portions are constructed of at least two layers of material or fabric which are both continuous and contiguous over the length and width of the front panel portions. A strong jacket front which can easily be manufactured with commonly available sewing apparatus results with significant efficiency in use of fabric and closure devices. The labor necessary to manufacture the jackets or vests with the pockets described above is significantly less than labor necessary to manufacture conventional jacket structures.

DESCRIPTION OF THE PREFERRED EMBODIMENT OF THE INVENTION

This invention has as its purpose the improvement of conventional garment pocket design and improvement of the functional characteristics of the resulting jacket or vest.

DRAWINGS

Figure 1:
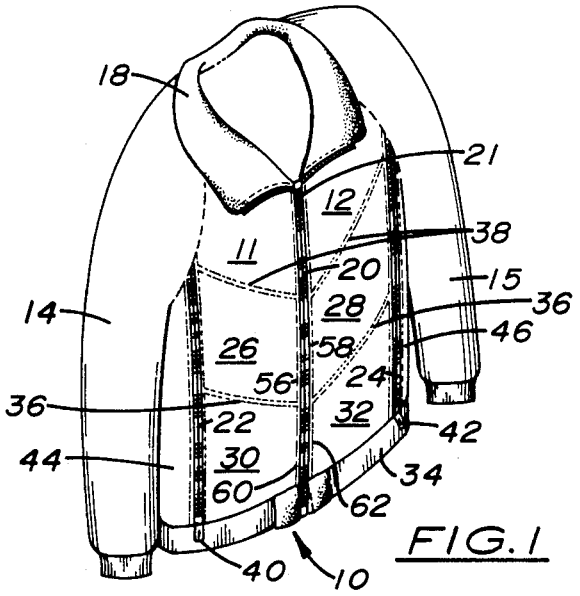
FIG. 1 is a perspective view of a jacket having the pocket structure of this invention.
Figure 3:
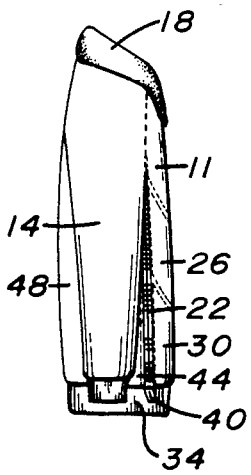
FIG. 3 is a side elevational view of the jacket shown in FIG. 1.

Referring specifically to the drawings, wherein like numerals indicate like parts, there is seen a jacket structure having four pockets positioned in the front panel of the jacket. The front panel 10 is divided into right front panel portion 11 and left front panel portion 12 and is joined together at the center of the front panel by front slide fastener 20. Slide fastener 20 is inter-engaged and dis-engaged by raising or lowering the front slide fastener pull 21. Panel portions 11 and 12 are made up of two layers of fabric and are connected at the margin opposite front slide fastener 20 to side panels 44 and 46 respectively. Also inter-engaging the front panel portions and the side panels are pocket closures 22 and 24, which will be described in detail below. Side panels 44 and 46 are sewn to the back panel 48 to complete the body portion of the garment. Sleeves 14 and 15 are attached in well-known "raglan" fashion to the upper portion of the front, side and back panels, as is shown in the drawings. Other means of attaching sleeves, such as "set-in" sleeves or other styles, may also be used with this invention. A waistband 34 is attached to the bottom portions of the foregoing panels, and a suitable collar is attached as shown to the upper portions of front panels 11 and 12, and the sleeves 14 and 15, and the back panel 48.

Figure 2:
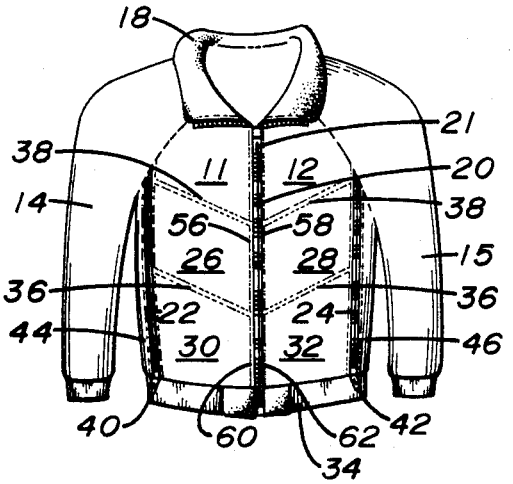
FIG. 2 is a front elevational view of the jacket shown in FIG. 1.

The double-layer construction of the front panels 11 and 12 facilitate the formation of pockets by providing mid-level stitching 36 and upper-level stitching 38, angled upwardly as shown from the front slide fastener 20. The attachment of front slide fastener 20 to the inner and outer layers of panels 11 and 12 form the central wall of pockets 26, 28, 30 and 32, with the lower margin of pockets 30 and 32 being defined by, and formed by the stitching required to attach waistband 34 to panels 11 and 12. The upper margin of pockets 30 and 32 are defined by the mid-level stitching 36, which also defines the lower margin of pockets 26 and 28. Similarly, the upper-level stitching 38 defines the upper margin of pockets 26 and 28. Closure mechanisms 22 and 24 are provided to permit access to the vertically adjacent pocket structures. For example, in the event one wishes to have access to pocket 30, closure 22 would be opened by raising pull 40 to open the side of pocket 30 and permit insertion of articles, or perhaps the hands of the wearer, as a warming pocket. In the event access is desired to pocket 26, pull 40 is raised further to open closure 22 to a level at which access to to the interior of pocket 26 is permitted. Closing the pockets 26 and 30 is accomplished by lowering pull 40 to the position shown in FIG. 2. Comparable actions are required to permit access to pockets 32 and 28, positioned in the left front panel portion 12.

It will be understood that the foregoing description merely illustrates the invention, and that modifications may be incorporated therein within the scope of the appended claims. For example, closures having pulls positioned at both the upper and lower ends thereof may be used to facilitate entry into the upper pocket without also opening the lower pocket on each side of the garment. Other closure mechanisms, such as hook-and-loop, buttoned flap, snaps and other similar well-known closure means can be used to provide access to the side-opening pockets described above. In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the legitimate and valid scope of the appended claims, appropriately interpreted in accordance with the doctrine of equivalents.

What is claimed is:

1. A garment intended to enclose the upper portion of a wear's body, said garment having a plurality of side-accessed pockets, each of said pockets extending across at least a portion of one front panel portion of said garment, said pockets being positioned one above the other and having a common side entry closure mechanism positioned along a common seam of the garment.

2. The apparatus of claim 1, wherein said pockets are formed by sewing through a first and second layer of material, forming the front of said garment, along a line extending from the center closure of said garment toward the sides thereof.

3. The garment of claim 2 wherein said front panel portion is formed from at least two layers of fabric which are continuous and contiguous across the length and width of said panel portion.

4. The garment of claim 1, wherein said closure comprises a zipper means extending from the anterior armpit area of said garment to the waistband thereof.

5. The garment of claim 1 wherein said closure mechanism is positioned at a side seam of said garment.

6. A method of manufacturing and outer wear garment having front panel portions joined along side seams to side panels, comprising the steps of:

preassembling first and second layers of fabric to form garment front panel portions having side and center margins, each of said portions being joined together with an appropriate half of a closure means for the center closure of the garment, attached along said center margin of each of said panel portions to form a front panel assembly;

forming side seams between one of said layers of fabric of said front panel portions and said side panels including a closure means half therein;

attaching a mating closure means half to said side margin of the other layer of said front panel portions; and, forming pocket structures by stitching through the layers of said front panel assembly to create a first line of stitching extending between said center closure half and said side seam closure on a line positioned mid level of the front of the jacket, and a second line of stitching substantially parallel to said first line, at a position above said first line, whereby two pockets are formed in said garment front panel portion.

7. The method of claim 6, wherein said stitching extends diagonally down from said side seam closure to the center closure half, so that when the jacket is fully assembled and the center closure is closed said stitching forms a chevron.

8. The method of claim 6, wherein the side closure means of the pocket structure comprises a zipper means which is installed at the side seam of the garment.

* * * * *